US009691259B2

(12) United States Patent
Finet

(10) Patent No.: US 9,691,259 B2
(45) Date of Patent: Jun. 27, 2017

(54) METHOD TO ACTIVATE EMERGENCY ALARM ON A PERSONAL ALARM SAFETY SYSTEM DEVICE

(75) Inventor: Tristan Finet, Picardie (FR)

(73) Assignee: Honeywell International, Inc., Morristown, NJ (US)

( * ) Notice: Subject to any disclaimer, the term of this patent is extended or adjusted under 35 U.S.C. 154(b) by 1109 days.

(21) Appl. No.: 13/433,761

(22) Filed: Mar. 29, 2012

(65) Prior Publication Data

US 2013/0257612 A1 Oct. 3, 2013

(51) Int. Cl.

*G08B 25/01* (2006.01)
*A62B 1/04* (2006.01)
*A62B 9/00* (2006.01)

(52) U.S. Cl.

CPC ..... *G08B 25/016* (2013.01); *A62B 1/04* (2013.01); *A62B 9/003* (2013.01); *A62B 9/006* (2013.01)

(58) Field of Classification Search

CPC .... G08B 17/117; G08B 19/005; G08B 23/00; G08B 27/001; G08B 2001/00; G08B 17/06; G08B 21/0415; G08B 21/0407; G08B 25/00; G08B 2001/08; G08B 21/02; G08B 21/22; G08B 223/00; G08B 21/04; G08B 21/182; G08B 21/06; G08B 1/08; G08B 3/10; G08B 5/22; G08B 5/40; G08B 7/06; G08B 29/04; G08B 29/043; G06F 3/0346; G06F 3/037; G06F 9/00; G06F 1/163; G06F 1/00; G06F 3/0354; A62B 7/00; A62B 17/00; A62B 25/00; A62B 35/00; A62B 35/0006; A62B 9/006; A62B 18/04; A62B 29/00; A62B 35/0025; A62B 7/12; A62B 1/00; A62B 1/04; A62B 9/003; A62B 5/00

USPC ..... 340/539.11, 384.6, 573.1, 540, 691.8, 340/384.73, 574, 547, 573, 692; 455/557, 455/404.2, 556.1, 41, 344; 128/204.22, 128/204.23, 202.19, 206.24, 201.27; 702/141

See application file for complete search history.

(56) References Cited

U.S. PATENT DOCUMENTS

| | | | | |
|---|---|---|---|---|
| 5,317,305 | A * | 5/1994 | Campman | 340/573.1 |
| 5,541,579 | A | 7/1996 | Kiernan | |
| 5,640,148 | A | 6/1997 | Lewis et al. | |
| 5,949,337 | A * | 9/1999 | Campman | 340/573.1 |
| 5,990,793 | A * | 11/1999 | Bieback | 340/573.1 |
| 6,016,099 | A * | 1/2000 | Campman | 340/321 |
| 6,819,247 | B2 | 11/2004 | Birnbach et al. | |
| 7,538,666 | B2 | 5/2009 | Campman | |
| 2007/0281745 | A1 * | 12/2007 | Parkulo et al. | 455/557 |

(Continued)

FOREIGN PATENT DOCUMENTS

| | | |
|---|---|---|
| EP | 0 800 844 | 10/1997 |
| EP | 2 302 881 | 3/2011 |

(Continued)

*Primary Examiner* — Mirza Alam

(74) *Attorney, Agent, or Firm* — Wood, Phillips, Katz, Clark & Mortimer

(57) ABSTRACT

A personal alert safety system comprises a housing adapted to be worn by a user. An accelerometer is in the housing. An alarm device is operatively associated with the housing. A control in the housing is operatively connected to the accelerometer and the alarm device. The control is configured to operate the alarm device responsive to select acceleration movement of the housing sensed by the accelerometer.

14 Claims, 3 Drawing Sheets

(56) References Cited

U.S. PATENT DOCUMENTS

| | | | | |
|---|---|---|---|---|
| 2008/0303644 | A1 | 12/2008 | Landis | |
| 2010/0256947 | A1* | 10/2010 | Kim et al. | 702/141 |
| 2011/0128147 | A1 | 6/2011 | Pan | |

FOREIGN PATENT DOCUMENTS

| | | |
|---|---|---|
| WO | WO 97/19726 | 6/1997 |
| WO | WO 2011/021068 | 2/2011 |

* cited by examiner

METHOD TO ACTIVATE EMERGENCY ALARM ON A PERSONAL ALARM SAFETY SYSTEM DEVICE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

This application relates to a personal alarm safety system device and, more particularly, to a new method to start an emergency alarm.

BACKGROUND

Statistics have shown that interventions in fire situations present important risks. In particular, firefighters suffer from heat and smoke caused by the fire and need to alert other fire fighting personnel for assistance. Personal alert safety system (PASS) devices are designed to assist firefighters during their mission. PASS devices provide audible alarms and/or visual indications responsive to various undue conditions.

Generally, PASS devices detect firefighter motion, surrounding temperature, air pressure of self contained breathing apparatus (SCBA) cylinders etc. If the PASS device detects the immobility of the firefighter, the PASS device generates a loud alarm to alert other personnel that a firefighter is in a hazardous situation. It helps to guide rescue personnel to the location of the incapacitated firefighter.

Known PASS devices may include controls to manually initiate an emergency alarm. If the firefighter is in a hazardous situation and wants to warn others, then the firefighter can manually initiate the alarm. Among the reasons for the firefighter to manually initiate an emergency alarm could be if the firefighter has any problem with the SCBA, if the firefighter is trapped somewhere, if the firefighter is under a collapsed structure and can't move, if the firefighter is injured or almost unconscious, or if the firefighter is surrounded by the fire.

Some known PASS devices provide for manual activation of the emergency alarm by the use of an electromechanical push button system. For example, the emergency alarm can be manually generated by pushing a button. The aim of this alarm is to alert others that a firefighter is in hazardous situation. It helps to guide rescue personnel to the location of the incapacitated firefighter.

One such PASS device uses a coupling between a sensor such as a reed switch and a magnet. The magnet is push by a plastic part (the button) to approach the reed switch. The reed switch is placed inside the device. The magnetic field of the magnet has enough power of attraction to close the reed switch. The reed switch is part of a non-contact position detector which connects directly to the interrupt input of a microcontroller.

Concerns may exist due to sensors being sensitive to electromagnetic fields or to antistatic plastic. Also, the buttons can wear out the button may be difficult to operate.

This application is directed to improvements in personal alert safety system devices.

SUMMARY

Broadly, there is disclosed a personal alert safety system device that senses acceleration movement of the device.

In accordance with one embodiment a personal alert safety system comprises a housing adapted to be worn by a user. An accelerometer is in the housing. An alarm device is operatively associated with the housing. A control in the housing is operatively connected to the accelerometer and the alarm device. The control is configured to operate the alarm device responsive to select acceleration movement of the housing sensed by the accelerometer.

It is a feature that the select acceleration movement comprises a single tap of the housing in any direction or a double tap of the housing in any direction.

It is another feature that the accelerometer sends an interrupt signal to the control. The control may comprise a microcontroller.

It is still another feature that the alarm device comprises a speaker.

It is a further feature that the housing is adapted to be mounted to a pressure hose of a self contained breathing apparatus and further comprising a pressure sensor operatively connected to the control for sensing pressure in the hose. A control is automatically activated responsive to sensed pressure.

It is an additional feature that the housing is adapted to receive an activation key operatively associated with the control. The control is activated responsive to removal of the activation key.

In accordance with another aspect, a method of generating an emergency alarm in a personal alert safety system comprises providing a housing adapted to be worn by a user, the housing including an accelerometer in the housing and an alarm device; and providing a control in the housing operatively associated with the accelerometer and the alarm device, the control operating the alarm device responsive to select acceleration movement of the housing sensed by the accelerometer.

Other features and advantages will be apparent from a review of the entire specification, including the appended claims and drawings.

DETAILED DESCRIPTION

Figure 1:
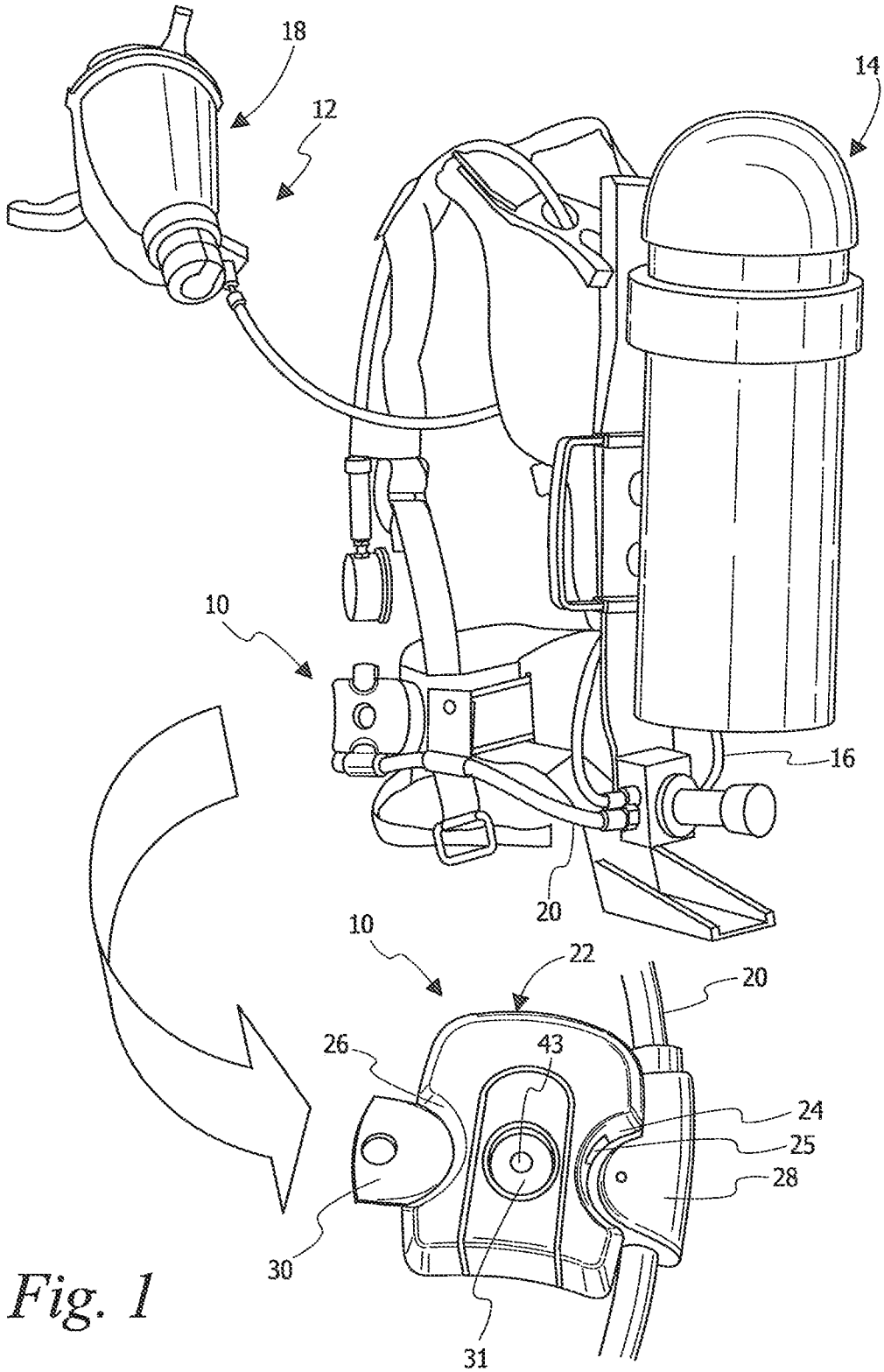
FIG. 1 is a perspective view of a PASS used with an SCBA.

Referring initially to FIG. 1, a personal alert safety system (PASS) 10 is shown in use with a self-contained breathing apparatus (SCBA) 12. As described herein, the PASS 10 may be used with the SCBA 12 or independently, as necessary or desired. The SCBA 12 does not form part of the invention and is illustrated as an example of one form of an SCBA 12. The PASS 10 may be operable to detect firefighter motion, surrounding temperature, air pressure of SCBA cylinders, or the like. This application is not directed to these features, but rather a new method to manually start an emergency alarm.

The SCBA 12 includes a high pressure air tank 14 providing breathable air in accordance with the EN12021 Standard. The SCBA 12 air is provided through a hose 16 to a mask 18. The PASS 10 is operatively connected to a pressure hose 20 also connected to the tank 14.

Figures 2, 3:
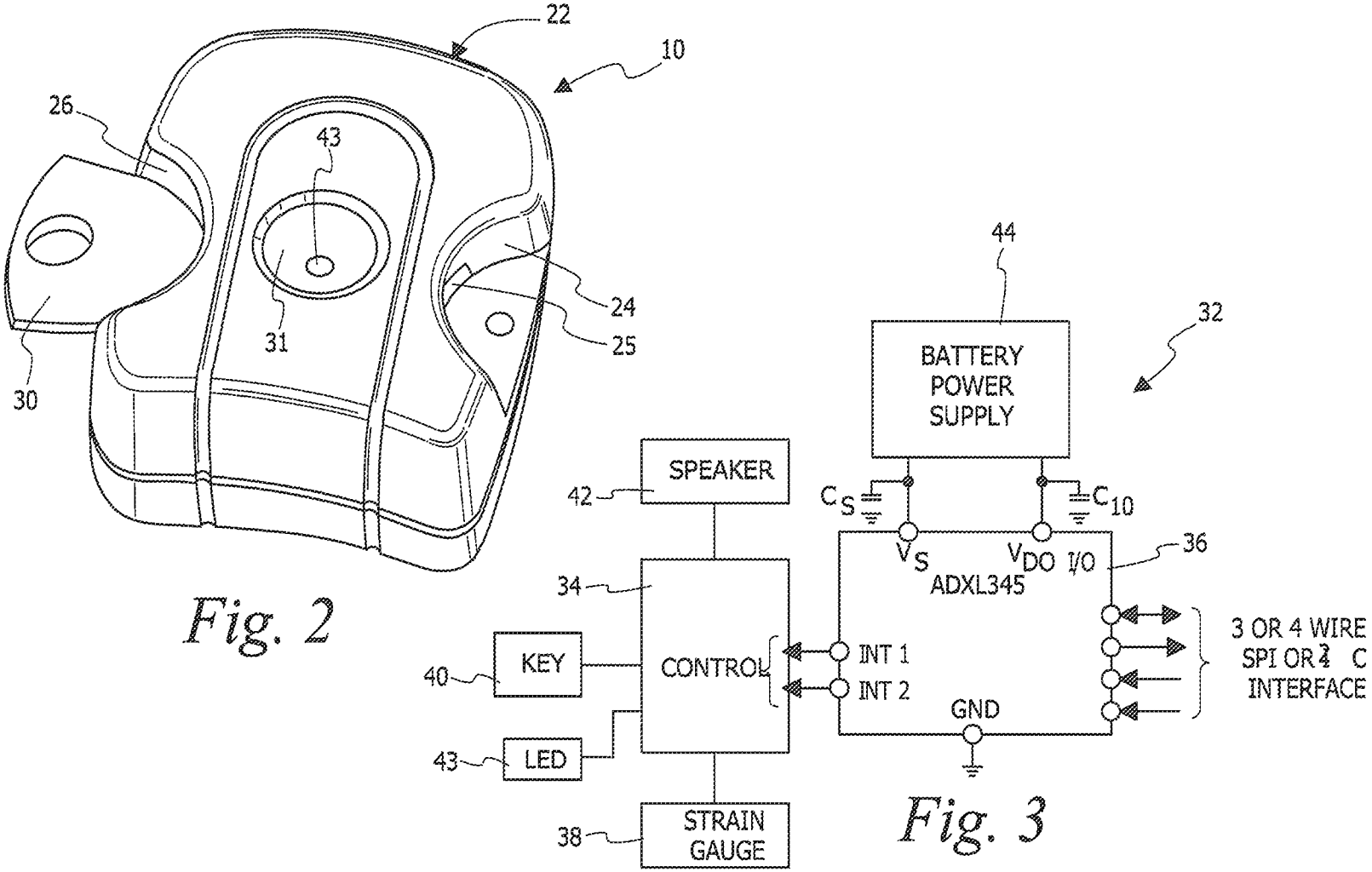
FIG. 2 is a perspective view of a PASS used as an independent device.
FIG. 3 is a block diagram of the PASS of FIGS. 1 and 2.

The PASS 10 includes a housing 22 of generally parallelepiped construction including opposite insets 24 and 26. The first inset 24 has a sound hole 25. The first inset 24 also receives an adaptor 28 through which the pressure hose 20 passes. The second inset 26 also has a sound hole (not shown) and receives an activation key 30. The sound holes open into the housing 22 and connect an internal tunnel for passing the audio alarm. A lens 31 between the insets 24 and 26 overlies an LED 43. As described below, the PASS 10 is activated, i.e., enabled for operation, responsive to the hose 20 being under pressure. In some instances, the PASS 10 may be used without the pressure hose 20 and adaptor 28, as shown in FIG. 2. In these instances, the activation key 30 must be removed to activate circuitry in the device.

Referring to FIG. 3, a block diagram illustrates an electronic circuit 32 contained on a circuit board within the housing 22. The control circuit 32 includes a control 34 for controlling operation of the PASS 10. The control 34 may comprise a microcontroller including a processor and associated memory and operating in accordance with a control program for controlling operation of the PASS 10. The circuit 32 includes an accelerometer 36 having an output at terminals INT 1 and INT 2 connected to an interrupt input of the control 34. The control 34 is also connected to a strain gauge 38, a key detector block 40, a speaker 42 and the LED 43. The speaker 42 may comprise, for example, a speaker and transducer functioning as a buzzer for generating an audio alarm that is dispersed through the sound holes 25.

Figure 4:
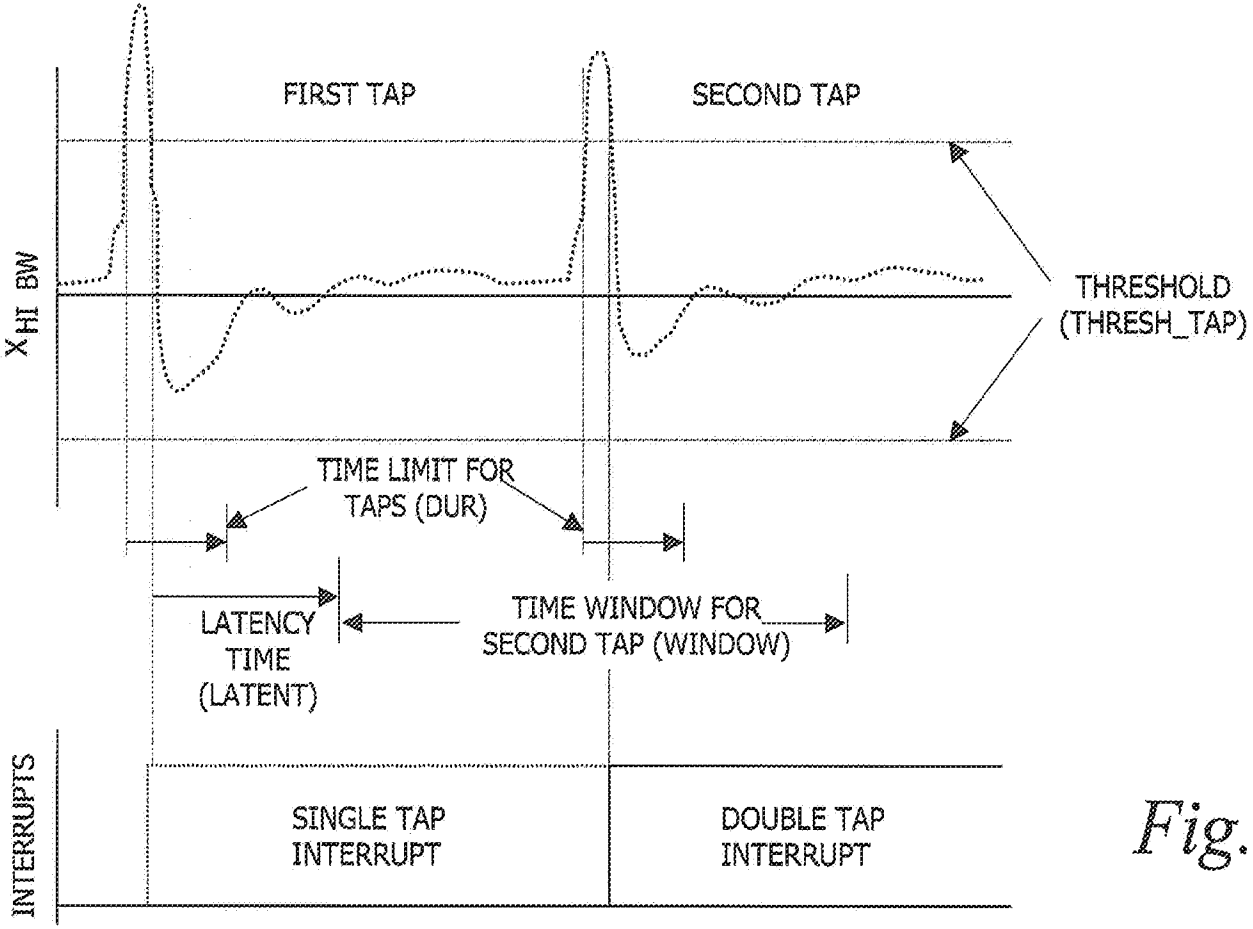
FIG. 4 is a timing diagram illustrating communication between the accelerometer of FIG. 3 and the control.

The accelerometer 36 as described herein comprises a type ADXL345 digital accelerometer. The accelerometer 36 is a low power device controlled by battery power from a power supply 44. The accelerometer 36 measures dynamic acceleration resulting from pre-defined motion. Particularly, tap sensing functionality is able to detect single and double taps in any direction. Because the accelerometer 36 is fixedly mounted in the housing 22, the accelerometer 36 is operable to sense tapping motion on the housing 22. The accelerometer 36 is operated as illustrated in FIG. 4 which compares acceleration to a threshold. The maximum tap duration time is defined by a value DUR. A tap latency time is a waiting period from the end of a first tap until the start of a time window when a second tap can be detected. An interval after the latency time is defined by a window register. Although a second tap must begin after a latency time has expired, the second tap does not have to finish before the end of the tap defined by the window register. The control circuit 32 can be used for either single tap operation or double tap operation although double tap is preferred to avoid inadvertent operation. A single tap interrupt is triggered when acceleration goes below the threshold as long as the duration DUR has not been exceeded. A double tap interrupt is triggered when a second tap is sensed within the time window for the second tap.

The control 34 is programmed to sense the interrupt from the accelerometer 36 and immediately initiate an alarm signal by providing a loud tone out the speaker 42. A visual indication is provided by the LED 43. Activation of the device and the alarm function are enabled by either the strain gauge 38 sensing a pressure condition from the high pressure hose 20, in the configuration of FIG. 1, or by removal of the key 30, in the configuration of FIG. 2, as sensed by the key detector block 40.

As described herein, manual initiation of an emergency alarm may be based on a double tap made on a specific axis with predetermined frequency and strength, as determined by the settings made in the accelerometer 36. As a result, the PASS 10 is easy to use with gloves and without sensitivity to how it is operated. The firefighter or other user need not search for a button in order to generate the alarm. Moreover, the accelerometer 36 is not sensitive to electromagnetic fields or anti-static plastic and the PASS 10 does not rely on buttons or the like which can wear out and require moving parts. In fact, there are fewer mechanical parts which can provide for faster assembly. This also results in lower manufacturing costs.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible. Other embodiments may be within the scope of the following claims.

The invention claimed is:

1. A personal alert safety system comprising:

a housing adapted to be worn by a user;

an accelerometer in the housing;

an alarm device operatively associated with the housing; and a control in the housing operatively connected to the accelerometer and the alarm device, the control being configured to operate the alarm device responsive to select acceleration movement of the housing sensed by the accelerometer.

2. The personal alert safety system of claim 1 wherein the select acceleration movement comprises a single tap of the housing in any direction.

3. The personal alert safety system of claim 1 wherein the select acceleration movement comprises a double tap of the housing in any direction.

4. The personal alert safety system of claim 1 wherein the accelerometer sends an interrupt signal to the control.

5. The personal alert safety system of claim 1 wherein the alarm device comprises a speaker.

6. The personal alert safety system of claim 1 wherein the housing is adapted to be mounted to a pressure hose of a self contained breathing apparatus and further comprising a pressure sensor operatively connected to the control for sensing pressure in the pressure hose and the control is automatically activated responsive to sensed pressure.

7. The personal alert safety system of claim 1 wherein the housing is adapted to receive an activation key operatively associated with the control and wherein the control is activated responsive to removal of the activation key.

8. A method of generating an emergency alarm in a personal alert safety system comprising:

providing a housing adapted to be worn by a user, the housing including an accelerometer in the housing and an alarm device; and providing a control in the housing operatively associated with the accelerometer and the alarm device, the control operating the alarm device responsive to select acceleration movement of the housing sensed by the accelerometer.

9. The method of generating an emergency alarm in a personal alert safety system of claim 8 wherein the select acceleration movement comprises a single tap of the housing in any direction.

10. The method of generating an emergency alarm in a personal alert safety system of claim 8 wherein the select acceleration movement comprises a double tap of the housing in any direction.

11. The method of generating an emergency alarm in a personal alert safety system of claim 8 wherein the accelerometer sends an interrupt signal to the control.

12. The method of generating an emergency alarm in a personal alert safety system of claim 8 wherein the alarm device comprises a speaker.

13. The method of generating an emergency alarm in a personal alert safety system of claim 8 wherein the housing is adapted to be mounted to a pressure hose of a self contained breathing apparatus and further comprising sensing pressure in the pressure hose and the control is automatically activated responsive to sensed pressure.

14. The method of generating an emergency alarm in a personal alert safety system of claim 8 wherein the housing is adapted to receive an activation key operatively associated with the control and wherein the control is activated responsive to removal of the activation key.

* * * * *